US005279245A

United States Patent [19]

Braud et al.

[11] Patent Number: 5,279,245

[45] Date of Patent: Jan. 18, 1994

[54] PROTECTION DEVICE FOR A TURRET BEARING

[75] Inventors: Jean Braud, La Turbie, Monaco; René Perratone, Menton, France

[73] Assignee: Single Buoy Moorings Inc., Marly, Switzerland

[21] Appl. No.: 789,886

[22] Filed: Nov. 12, 1991

[51] Int. Cl.[5] ..... B63B 21/00

[52] U.S. Cl. ..... 114/230

[58] Field of Search ..... 441/3-5; 114/230; 384/322, 368, 371, 397, 398

[56] References Cited

U.S. PATENT DOCUMENTS 3,651,525 3/1972 Rutten et al. ..... 441/5

3,735,435 5/1973 Mikulicic et al. ..... 441/5

*Primary Examiner*—Edwin L. Swinehart

*Attorney, Agent, or Firm*—Young & Thompson

[57] ABSTRACT

Protection device for a turret bearing arranged between a floating structure and a mooring member. A turret bearing is arranged at or below water level to provide an effective introduction of forces as near the lower side of the floating structure as possible. To guarantee lubrication of the turret bearing a labyrinthine chamber is provided around the turret bearing. The downwardly extending part of this chamber is realized by the floating structure and more particularly a reinforced box whilst the upwardly extending part is provided by a wall extending from the body of the mooring member.

7 Claims, 2 Drawing Sheets

PROTECTION DEVICE FOR A TURRET BEARING

This invention relates to a protection device for a turret bearing arranged between a floating structure and a mooring member, said turret bearing being at or below water level.

Such a protection device is e.g. known from U.S. Pat. No. 3,735,435 and comprises an assembly of O-rings. Furthermore in the prior art other sealing systems with lips have been proposed.

Floating structures are connected to the sea bed through mooring members. The mooring members are anchored to the sea bed and connected to the floating structure by a turret bearing. To keep the tilting moment arising from the arm between the point of engagement of the anchor means to the mooring member and the connection of the mooring member through the turret bearing to the floating structure as short as possible, it is proposed in the art to arrange the turret bearing as low as possible. This means that the position of the turret bearing is at or below water level. To guarantee sufficient service life of the turrent bearing it is necessary to protect the bearing from the influence of sea water. Because of the relatively large diameter of the mooring member and so of the turret bearing the movements at the sealing face are relatively large imposing considerable wear and tear to the sealing components. In U.S. Pat. No. 3,735,435 the annular chamber in which the turret bearing is provided is filled with oil. If during normal circumstances the seal is damaged problems will not immediately arise because the oil will float on the water which will ingress through the damaged seal. However, if the sea is relatively rough the possibility exists for the oil to escape from underneath the tanker during pitching or rolling, this oil chamber will then be filled with water resulting in a direct contact between the water and the bearing. Consequently, the lifetime of the bearing will be shortened.

The invention aims to obviate this drawback.

According to the invention this is realized in that the mooring member is provided with an annular upwardly extending wall and the floating structure is provided with a downwardly extending annular part to create within said annular wall a labyrinthine chamber.

By providing a labyrinthine chamber the liquid contents of the chamber are prevented from being emptied during excessive tanker motions. Preferably the chamber should be at least partially filled with a lubricating substance, such as oil and/or grease.

According to a preferred embodiment the chamber is provided with flow damping means such as vertical baffles. Flow induced by pitching and other motion of the floating structure is considerably restricted such that it is prevented that oil will escape and/or water will enter.

Preferably the downwardly extending part of the floating structure is a reinforced box. Such reinforced boxes are provided to give a rigid base for the turret bearing.

The wall extending from the mooring member to provide the outer circumference of the labyrinthine chamber can simply be realized with an L-shaped plate connected with the mooring body.

The invention will be further elucidated referring to the enclosed drawings.

DESCRIPTION OF THE PREFERRED EMBODIMENT

Figure 1:
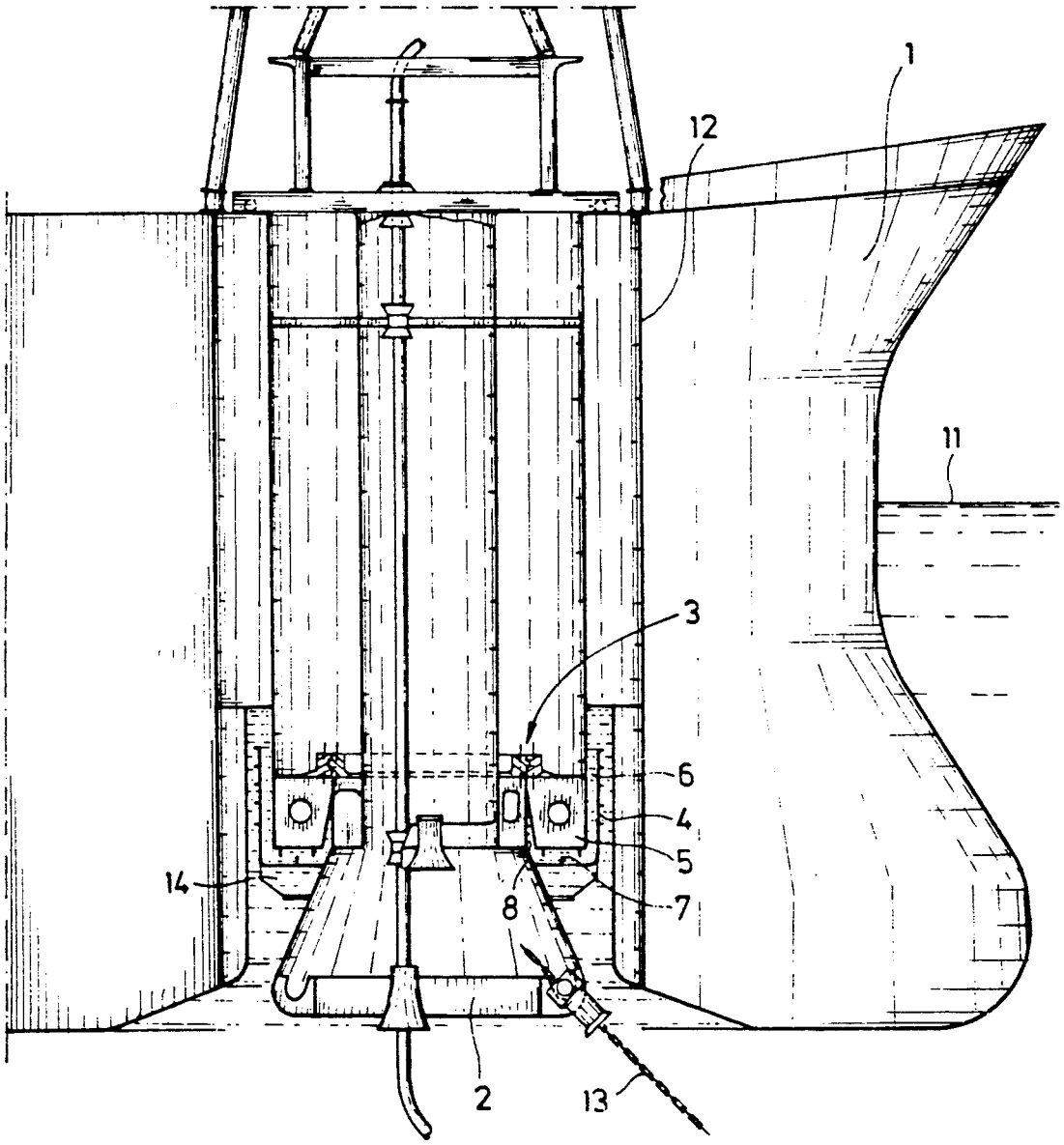
FIG. 1 is a partial side view of a floating structure according to the invention partially in cross section.

In FIG. 1 a floating structure is generally identified with 1. A part of it is above water level 11 and another part is below water level 11. In the front portion of floating structure 1 a tubular passage 12 is provided, in the lower part of which a reinforced box 5 is arranged on which bearings 3 are provided. Bearings 3 function to provide a rotatable connection to mooring member 2 which can be connected to and disconnected from box 5. Mooring member 2 is connected to the sea bed through anchor chains 13 of which only one is shown. Through the connection of mooring member 2 with the sea bed the floating structure 1 is anchored. However, it is possible that depending on the weather the floating structure can rotate relatively to mooring member 2. Because considerable momentum forces arise from the connection of mooring member 2 to floating structure 1, it is of importance that bearings 3 are as near as possible to the point of engagement of anchor chains 13. However, this means that bearings 3 are well below water level 11.

Figure 2:
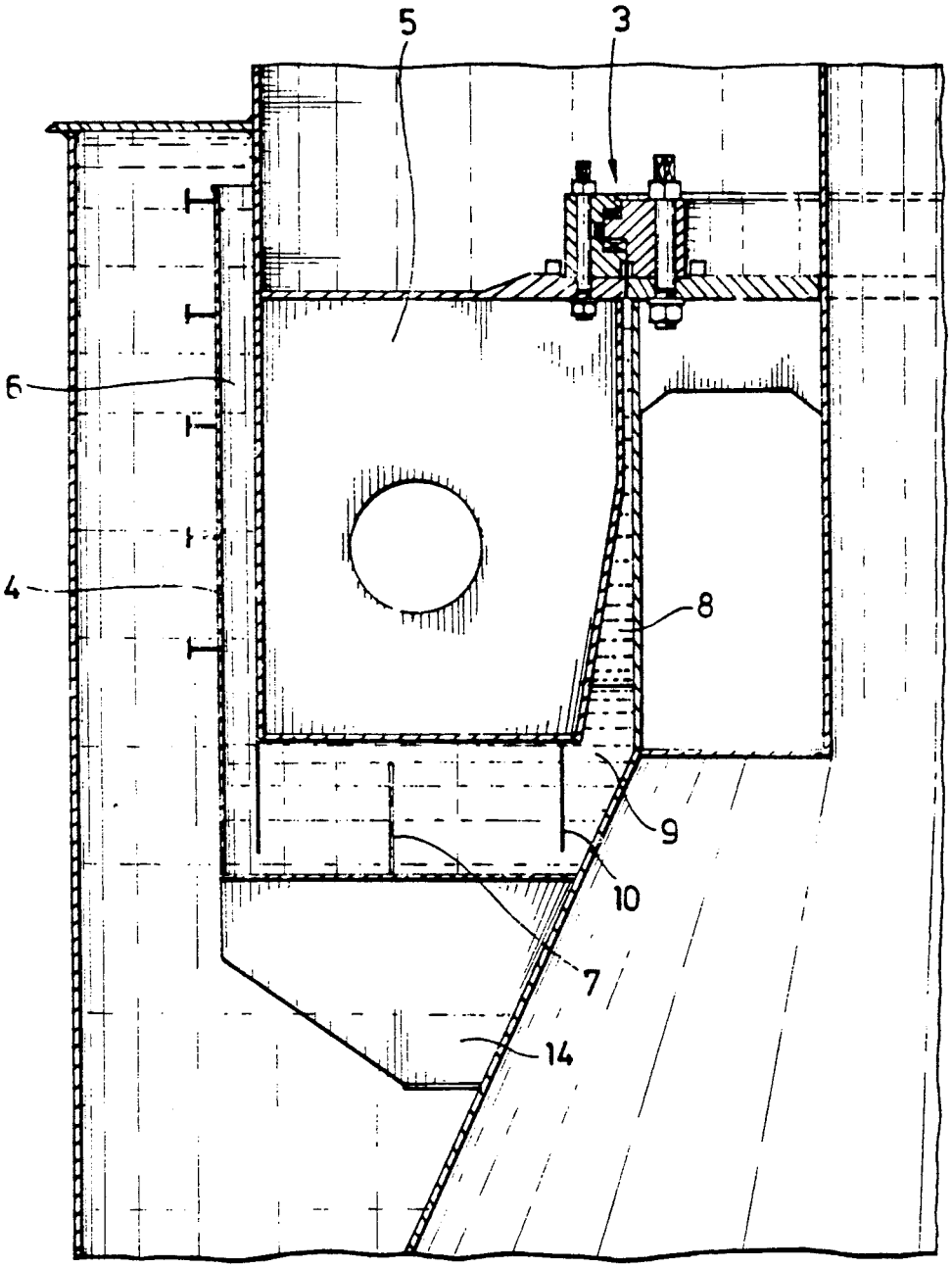
FIG. 2 is a detail of FIG. 1.

In FIG. 2 a more detailed view is given of the connection of the mooring member 2 through bearing 3 to reinforced box 5. Bearing 3 is known as such and in the art sealing members were provided between reinforced box 5 and the body of the mooring member 2. According to the invention this problem will be solved by connection, e.g. welding, to the outer body of the mooring member 2 a wall 4 supported by bracket plate 14. Wall 4 is preferably L-shaped in section. From the lower part of wall 4 baffles 7 extend upwardly whilst from the lower part of reinforced box 5 baffles 10 extend downwardly. Baffles 7, 10 act as dampening means to prevent surgeing away of oil when water disappears outside of wall 4. Between reinforced box 5 and wall 4 a chamber 6 is provided. According to the invention initially this chamber is partially filled with water after which oil or any other lubrication means 8 is introduced in space 9. When further water is introduced this oil will float on the water as is indicated in FIG. 2. If there is no water present outside of wall 4 the lubrication means 8 will remain intact trapped by the water which is always present.

In this way a very effective and maintenance free barrier against the influence of water is provided for a bearing below water level whilst lubrication of this bearing is guaranteed.

It has to be understood that the embodiment shown is a preferred embodiment at the time being but many changes are possible within the claimed scope of protection comprising any embodiment of a labyrinthine chamber.

We claim:

1. A floating structure having a mooring member rotatable relative to the floating structure about an upright axis, said floating structure surrounding said mooring member, a lower turret bearing disposed between said floating structure and said mooring member, said turret bearing having a portion secured to said mooring member and a portion secured to the floating structure, the floating structure having an annular member extending downwardly from said portion of said bearing secured to the floating structure, the mooring member having an annular member which defines with said annular member of the floating structure an annular chamber of U-shaped cross section having radially inner and outer legs relative to said upright axis, said inner leg communicating with the bearing and said outer leg communicating with the water in which said floating structure floats.

2. A floating structure as claimed in claim 1, wherein said U-shaped chamber is provided with flow damping means.

3. A floating structure as claimed in claim 2, wherein said flow damping means comprise vertical baffles.

4. A floating structure as claimed in claim 1, wherein said downwardly extending annular member is a reinforced box, and wherein said annular member carried by said mooring member comprises an annular plate of L-shaped cross section surrounding but spaced radially outwardly from said box relative to said upright axis.

5. A floating structure as claimed in claim 1, the part of said U-shaped chamber adjacent the bearing being filled with a lubricating substance having a specific gravity lower than water.

6. A floating structure as claimed in claim 5, wherein said lubricating substance is oil.

7. A floating structure as claimed in claim 5, wherein said lubricating substance is grease.

* * * * *